United States Patent [19]

Mandel et al.

[11] 4,032,882

[45] June 28, 1977

[54] ELEVATOR SYSTEM

[75] Inventors: Alan F. Mandel, Pittsburgh, Pa.; Louis M. Capuano, Westfield; Theodore E. Frask, Wayne, both of N.J.; Denis E. Bedel, Pittsburgh, Pa.

[73] Assignee: Westinghouse Electric Corporation, Pittsburgh, Pa.

[22] Filed: Feb. 17, 1976

[21] Appl. No.: 658,931

[52] U.S. Cl. ..... 340/19 R; 340/21; 340/332

[51] Int. Cl.[2] ..... G08B 5/36

[58] Field of Search ..... 340/19 R, 21, 82, 109

[56] References Cited

UNITED STATES PATENTS

| | | | |
|---|---|---|---|
| 634,229 | 10/1899 | Collett | 340/19 R |
| 1,655,787 | 1/1928 | Harris | 340/82 |
| 1,691,798 | 11/1928 | Cypser | 340/21 |
| 1,819,247 | 8/1931 | Kinnard | 340/21 X |
| 1,848,366 | 3/1932 | Lewis | 340/19 R |
| 2,980,886 | 4/1961 | Yeakley | 340/19 R |
| 3,747,063 | 7/1973 | Hudson | 340/109 |
| 3,959,768 | 5/1976 | Mayo | 340/82 |

*Primary Examiner*—David L. Trafton
*Attorney, Agent, or Firm*—D. R. Lackey

[57] ABSTRACT

An elevator system including an elevator car mounted for movement in a building to serve the floors therein. The elevator system includes control apparatus for selecting the service direction in which the elevator car will proceed from a floor it is serving. A display having an array of electrically energizable elements visually indicates the selected up or down service direction by sequentially energizing the elements to provide a predetermined pattern which moves upwardly, or downwardly, through the array, or which causes a predetermined pattern to lengthen in the upward, or downward direction.

19 Claims, 62 Drawing Figures

FIG. 5
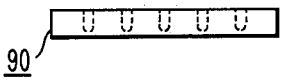
FIG. 7
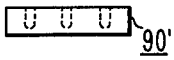
FIG. 9
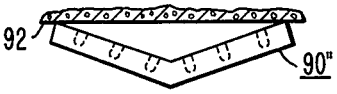
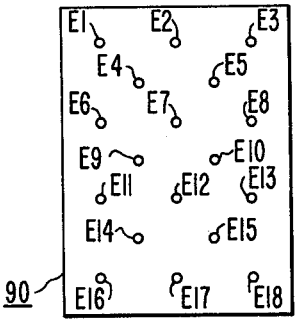
FIG. 4
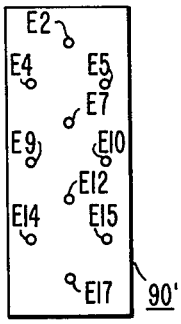
FIG. 6
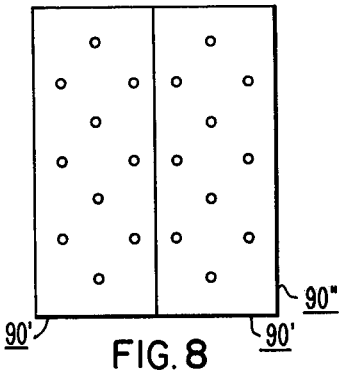
FIG. 8
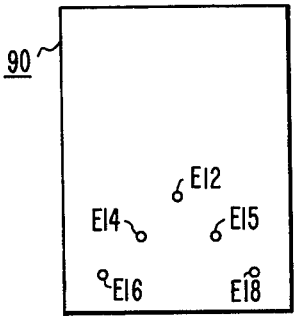
FIG. 10A
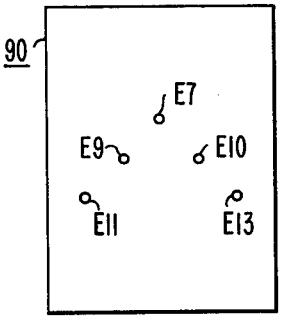
FIG. 10B
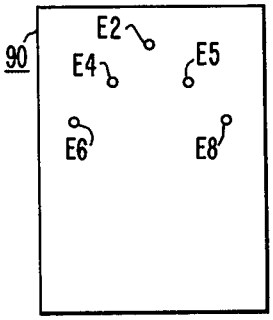
FIG. 10C
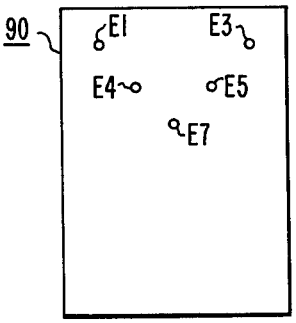
FIG. 10D
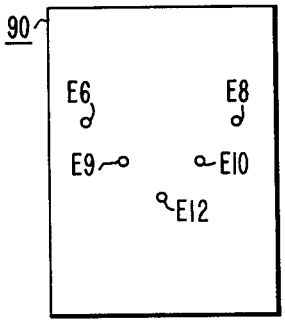
FIG. 10E
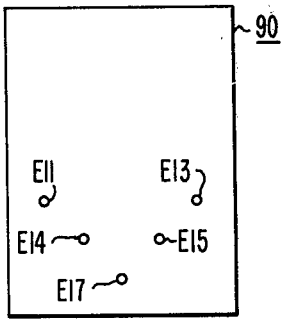
FIG. 10F FIG.11A
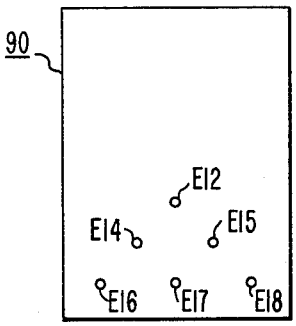
FIG.11B
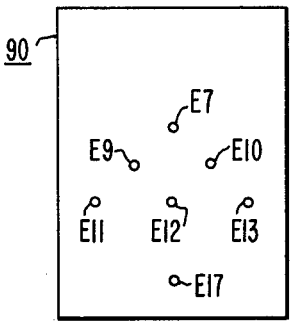
FIG.11C
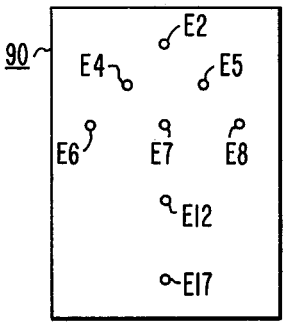
FIG.11D
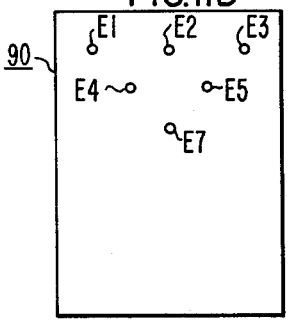
FIG.11E
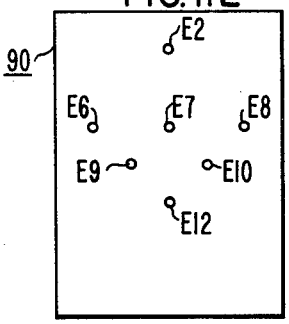
FIG.11F
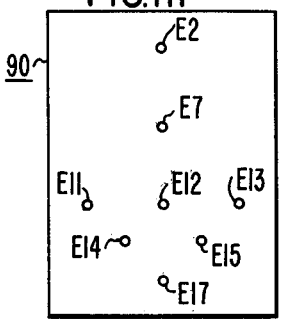
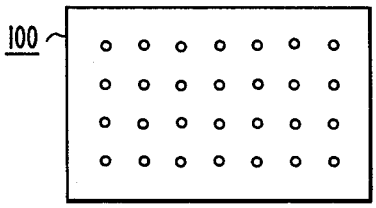
FIG.12
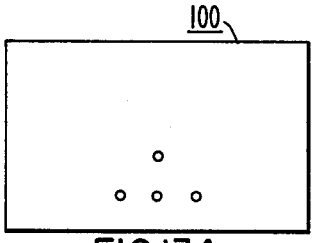
FIG.13A
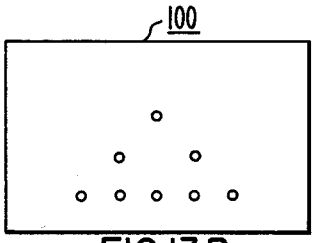
FIG.13B
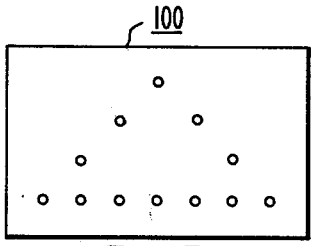
FIG.13C
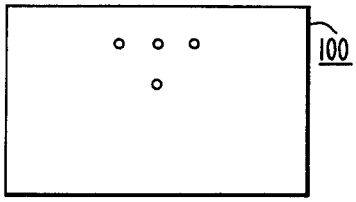
FIG.13D
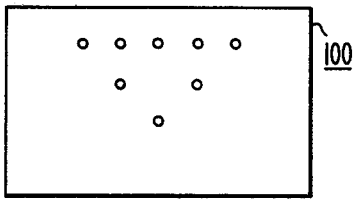
FIG.13E
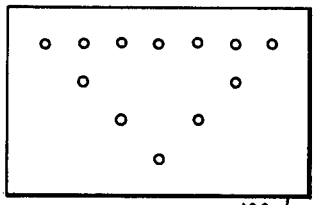
FIG.13F FIG.15
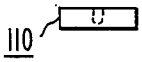
FIG.17
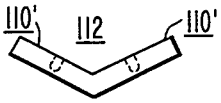
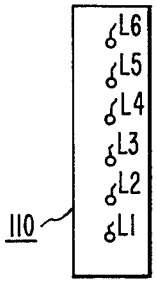
FIG.14
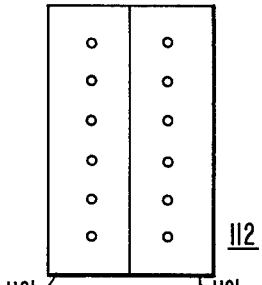
FIG.16
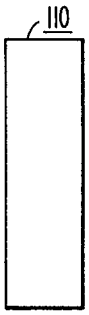
FIG.18A
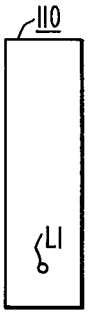
FIG.18B
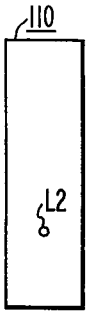
FIG.18C
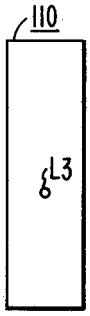
FIG.18D
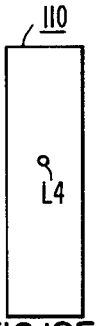
FIG.18E
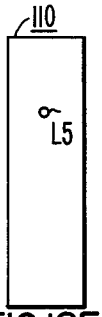
FIG.18F
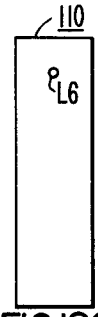
FIG.18G
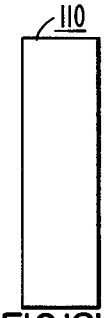
FIG.18H
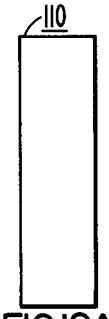
FIG.19A
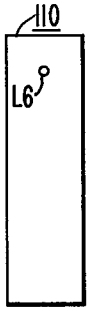
FIG.19B
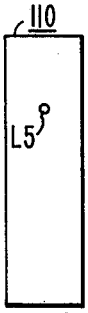
FIG.19C
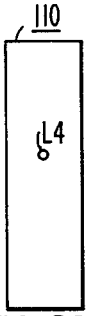
FIG.19D
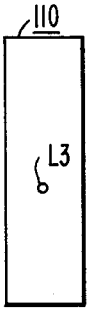
FIG.19E
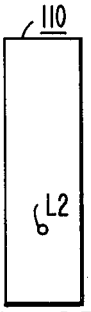
FIG.19F
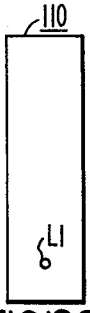
FIG.19G
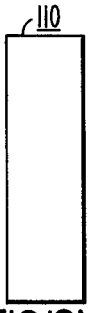
FIG.19H
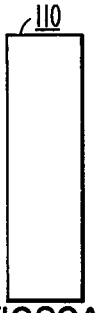
FIG.20A
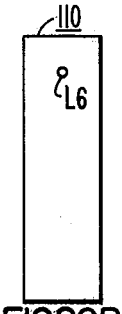
FIG.20B
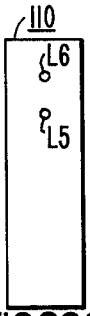
FIG.20C
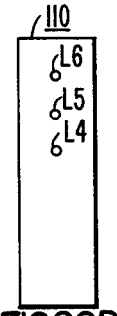
FIG.20D
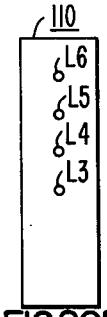
FIG.20E
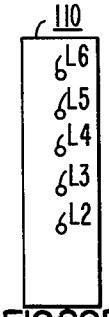
FIG.20F
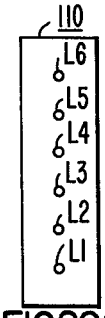
FIG.20G
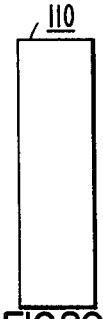
FIG.20H

ROM PROGRAM- NO TAIL

| INPUT HLD | INPUT HEX CODE | OUTPUT ROM 1 8 7 6 5 4 3 2 1 | OUTPUT ROM 2 8 7 6 5 4 3 2 1 | ENERGIZED ELEMENTS (ELEMENT #) | TONE |
|---|---|---|---|---|---|
| 0 | 0 | 0 0 0 0 0 0 0 0 | 0 0 0 0 0 0 0 0 | NONE | - |
| 0 | 1 | 0 0 0 1 0 1 0 1 | 1 0 0 0 0 0 0 0 | 1, 3, 4, 5, 7 | H |
| 0 | 2 | " | " | " | - |
| 0 | 3 | " | " | " | - |
| 0 | 4 | " | " | " | - |
| 0 | 5 | 0 0 0 0 0 0 0 0 | 0 0 0 0 0 0 0 0 | NONE | - |
| 0 | 6 | 1 0 1 0 1 0 0 0 | 1 0 1 0 0 0 0 0 | 6, 8, 9, 10, 12 | M |
| 0 | 7 | " | " | " | - |
| 0 | 8 | " | " | " | - |
| 0 | 9 | " | " | " | - |
| 0 | A | 0 0 0 0 0 0 0 0 | 0 0 0 0 0 0 0 0 | NONE | - |
| 0 | B | 0 1 0 0 0 0 0 0 | 1 0 0 1 0 1 0 1 | 11, 13, 14, 15, 17 | L |
| 0 | C | " | " | " | - |
| 0 | D | " | " | " | - |
| 0 | E | " | " | " | - |
| 0 | F | 0 0 0 0 0 0 0 0 | 0 0 0 0 0 0 0 0 | NONE | - |
| 1 | 0 | 0 0 0 0 0 0 0 0 | 0 0 0 0 0 0 0 0 | NONE | - |
| 1 | 1 | 1 0 0 0 0 0 0 0 | 1 0 0 1 0 0 1 1 | 12, 14, 15, 16, 18 | L |
| 1 | 2 | " | " | " | - |
| 1 | 3 | " | " | " | - |
| 1 | 4 | " | " | " | - |
| 1 | 5 | 0 0 0 0 0 0 0 0 | 0 0 0 0 0 0 0 0 | NONE | - |
| 1 | 6 | 0 1 1 1 0 0 0 0 | 1 0 1 0 0 0 0 0 | 7, 9, 10, 11, 13 | M |
| 1 | 7 | " | " | " | - |
| 1 | 8 | " | " | " | - |
| 1 | 9 | " | " | " | - |
| 1 | A | 0 0 0 0 0 0 0 0 | 0 0 0 0 0 0 0 0 | NONE | - |
| 1 | B | 0 0 0 0 1 1 1 0 | 1 0 0 0 0 0 0 0 | 2, 4, 5, 6, 8 | H |
| 1 | C | " | " | " | - |
| 1 | D | " | " | " | - |
| 1 | E | " | " | " | - |
| 1 | F | 0 0 0 0 0 0 0 0 | 0 0 0 0 0 0 0 0 | NONE | - |

FIG. 23

ROM PROGRAM- WITH TAIL

| INPUT HLD | INPUT HEX CODE | OUTPUT ROM 3 8 7 6 5 4 3 2 1 | OUTPUT ROM 4 8 7 6 5 4 3 2 1 | ENERGIZED ELEMENTS (ELEMENT #) | TONE |
|---|---|---|---|---|---|
| 0 | 0 | 0 0 0 0 0 0 0 0 | 0 0 0 0 0 0 0 0 | NONE | - |
| 0 | 1 | 0 0 0 1 0 1 1 1 | 1 0 0 0 0 0 0 0 | 1,2,3,4,5,7 | H |
| 0 | 2 | " | " | " | - |
| 0 | 3 | " | " | " | - |
| 0 | 4 | " | " | " | - |
| 0 | 5 | " | " | " | - |
| 0 | 6 | 1 0 1 1 1 0 1 0 | 1 0 1 0 0 0 0 0 | 2,6,7,8,9,10,12 | M |
| 0 | 7 | " | " | " | - |
| 0 | 8 | " | " | " | - |
| 0 | 9 | " | " | " | - |
| 0 | A | " | " | " | - |
| 0 | B | 1 1 0 1 0 0 1 0 | 1 0 0 1 0 1 0 1 | 2,7,11,12,13,14,15,17 | L |
| 0 | C | " | " | " | - |
| 0 | D | " | " | " | - |
| 0 | E | " | " | " | - |
| 0 | F | " | " | " | - |
| 1 | 0 | 0 0 0 0 0 0 0 0 | 0 0 0 0 0 0 0 0 | NONE | - |
| 1 | 1 | 1 0 0 0 0 0 0 0 | 1 0 0 1 0 1 1 1 | 12,14,15,16,17,18 | L |
| 1 | 2 | " | " | " | - |
| 1 | 3 | " | " | " | - |
| 1 | 4 | " | " | " | - |
| 1 | 5 | " | " | " | - |
| 1 | 6 | 1 1 1 1 0 0 0 0 | 1 0 1 0 0 1 0 0 | 7,9,10,11,12,13,17 | M |
| 1 | 7 | " | " | " | - |
| 1 | 8 | " | " | " | - |
| 1 | 9 | " | " | " | - |
| 1 | A | " | " | " | - |
| 1 | B | 1 0 0 1 1 1 1 0 | 1 0 0 0 0 1 0 0 | 2,4,5,6,7,8,12,17 | H |
| 1 | C | " | " | " | - |
| 1 | D | " | " | " | - |
| 1 | E | " | " | " | - |
| 1 | F | " | " | " | - |

FIG. 24

ELEVATOR SYSTEM

BACKGROUND OF THE INVENTION

1. Field of the Invention

The invention relates in general to elevator systems, and more specifically to elevator systems having a display which indicates the service direction in which an elevator car will proceed from a floor it is serving.

2. Description of the Prior Art

An elevator system conventionally includes a display for each car of the system which indicates to prospective passengers the service direction in which the elevator car will proceed from a floor it is serving. The display, usually referred to as a "hall lantern", may be mounted above or adjacent to the hatch door of the associated elevator car, at each floor the elevator car serves, or it may be carried by the elevator car in a location where it will be visible from the hallway when the car and hatch doors are open.

The hall lanterns usually include one incandescent lamp for each travel direction with the appropriate lamp being energized to indicate the travel direction of the car away from the associated floor. A gong is connected in series with the common line from each up and down hall lantern fixture, such that it produces a single sound when the associated up or down lamp is energized.

When the service direction indicator is hall mounted, the up or down lantern for a floor is energized before the actual arrival of the car at the floor, usually when the car initiates slowdown to stop at the floor. The selected hall lantern remains energized until the doors start to close, or until they are fully closed, as desired.

The incandescent lamps of conventional hall lantern fixtures are of the high voltage type and susceptible to failure due to the high in-rush current and also to the long and delicate lamp filaments.

It would be desirable to improve the hall lanterns of an elevator system by enabling the long life solid state display devices to be used, such as light emitting diodes, liquid crystals, and the like, but the hall lantern display must provide visible and audible signals which are suitable for the general public, including the handicapped. It is also important that the economic advantage to be achieved by reducing the number of service calls to replace burned out incandescent lamps, are not offset by the initial cost of the new hall lanterns.

SUMMARY OF THE INVENTION

Briefly, the present invention is a new and improved elevator system which includes new and improved display apparatus for indicating the direction in which an elevator car will proceed from the floor it is serving. The new and improved display apparatus includes a single array of electrically energizable elements, which array is used for both the up and down service directions. The array of elements is arranged and operated such that long life, solid state display devices may be used for the elements while providing superior visible signals which dynamically indicate service direction by a predetermined sequential operation of the elements. The dynamic aspect of the display will definitely improve the understandability of the display to the visually handicapped, compared with the static prior art displays. The steps of the sequential pattern may also be accompanied by an electronic tone on the initial run through the hall lantern sequence, with the frequency and/or magnitude of the tone being controlled to audibly indicate service direction to the blind.

BRIEF DESCRIPTION OF THE DRAWINGS

The invention may be better understood, and further advantages and uses thereof more readily apparent, when considered in view of the following detail description of exemplary embodiments, taken with the accompanying drawings in which:

FIGS. 4 and 5 are elevational and plan views, respectively, of a hall lantern fixture having an array of electrically energizable elements constructed according to an embodiment of the invention;

FIGS. 6 and 7 are elevational and plan views, respectively, of a hall lantern fixture which is similar to that shown in FIGS. 4 and 5, except with fewer elements in the array;

FIGS. 8 and 9 are elevational and plan views, respectively, of a hall lantern fixture constructed with two of the fixtures shown in FIGS. 6 and 7, arranged in a pyramidal form;

FIGS. 10A through 10F illustrate patterns and sequences thereof for the hall lantern fixture shown in FIGS. 4 and 5, with FIGS. 10A through 10C illustrating the patterns and sequences thereof for the up service direction and FIGS. 10D through 10F illustrating the patterns and sequences thereof for the down service direction;

FIGS. 11A through 11F illustrate alternative patterns and sequences thereof for the hall lantern fixture shown in FIGS. 4 and 5;

FIG. 12 is an elevational view of a hall lantern fixture constructed according to another embodiment of the invention;

FIGS. 13A through 13F illustrate patterns and sequences thereof for the hall lantern fixture shown in FIG. 12;

FIGS. 14 and 15 are elevational and plan views, respectively, of a hall lantern fixture constructed according to another embodiment of the invention;

FIGS. 16 and 17 are elevational and plan views, respectively, of a hall lantern fixture constructed by using two of the fixtures shown in FIGS. 14 and 15 arranged in a pyramidal form;

FIGS. 18A through 18H illustrate patterns, and sequences thereof, for the fixtures shown in FIG. 14, illustrating the up service direction;

FIGS. 19A through 19H illustrate patterns, and sequences thereof, for the fixtures shown in FIG. 14, illustrating the down service direction;

FIGS. 20A through 20H illustrate alternative patterns, and sequences thereof, for the fixtures shown in FIG. 14, illustrating the down service direction;

FIGS. 23 and 24 illustrate programs for programming read-only memories utilized in the pattern selection control circuitry shown in FIG. 22, for providing dynamic directional arrows without, and with, a tail, respectively;

DESCRIPTION OF PREFERRED EMBODIMENTS

The invention is a new and improved elevator system which includes 1 or more elevator cars mounted for movement in a building to serve the floors therein. Certain portions of the elevator system may be conventional, and in order to limit the length and complexity of the application, U.S. Pat. Nos. 3,750,850 and 3,804,209, which are assigned to the same assignee as the present application, are hereby incorporated into the present application by reference. U.S. Pat. No. 3,750,850 describes the operation of a single elevator car, and U.S. Pat. No. 3,804,209 discloses modifications to the floor selector shown in U.S. Pat. No. 3,750,850 for group supervisory control by a system processor. Both of these patents illustrate in detail the development of signals $\overline{HLU}$ and $\overline{HLD}$. Signal $\overline{HLU}$ is normally at the logic one level, and it goes true or to a logic zero level when the up hall lantern for a floor is to be energized. In like manner signal $\overline{HLD}$ is normally at the logic one level, and it goes true or to the logic zero level when the down hall lantern for a floor is to be energized.

Figure 1:
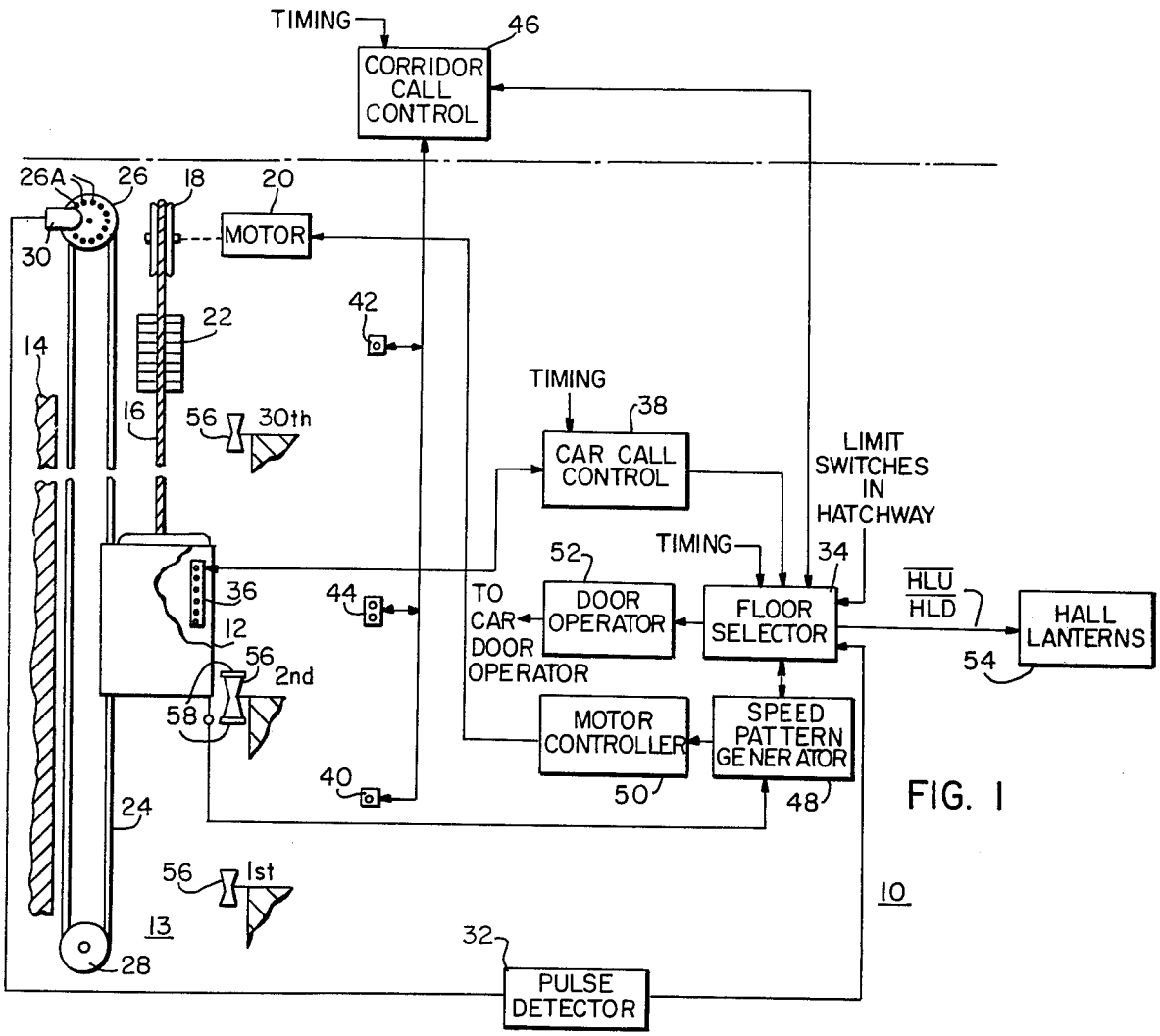
FIG. 1 is a block diagram of an elevator system which may be constructed according to the teachings of the invention.

Referring now to the drawings, and to FIG. 1 in particular, there is shown an elevator system 10 which may be constructed according to the teachings of the invention. Elevator system 10 includes an elevator car 12 mounted in the hatchway 13 for movement relative to a structure 14 having a plurality of floors or landings such as 30, with only the first, second and thirtieth floors being shown in order to simplify the drawing. The elevator car 12 is supported by a rope 16 which is reeved over a traction sheave 18 mounted on the shaft of a drive motor 20, such as a direct current motor as used in the Ward-Leonard drive system. A counterweight 22 is connected to the other end of the rope 16. A governor rope 24, which is connected to the elevator car 12, is reeved over a governor sheave 26 located above the highest point of travel of the car in the hatchway 13, and over a pulley 28 located at the bottom of the hatchway. A pickup 30 is disposed to detect movement of the car 12 through the effect of circumferentially spaced openings 26A in the governor sheave 26. Pickup 30 is connected to a pulse detector 32 which provides distance pulses for a floor selector 34.

Car calls, as registered by pushbutton array 36 mounted in the car 12, are recorded and serialized in car call control 38, and the resulting serialized car call information is directed to the floor selector 34.

Hall calls, as registered by pushbuttons mounted in the halls, such as the up pushbutton 40 located at the first floor, the down pushbutton 42 located at the thirtieth floor, and the up and down pushbuttons 44 located at the second and other intermediate floors, are recorded and serialized in hall call control 46. The resulting serialized hall call information is directed to the floor selector 34.

The floor selector 34 processes the distance pulses from the pulse detector 32 to develop information concerning the position of the car 12 in the hatchway 13, and it also directs these processed distance pulses to a speed pattern generator 48 which generates a speed reference signal for a motor controller 50, which in turn provides the drive voltage for motor 20.

The floor selector 34 keeps track of the car 12, the calls for service for the car, provides the request to accelerate signal to the speed pattern generator 48, and provides the deceleration signal for the speed pattern generator 48 at the precise time required for the car to decelerate according to a predetermined deceleration pattern and stop at a predetermined floor for which a call for service has been registered. The floor selector 34 also provides signals for controlling such auxiliary devices as the door operator, and it controls the resetting of the car call and hall call controls when a car or hall call has been serviced. The floor selector 34 also controls the hall lanterns, shown generally at 54 by providing the signals $\overline{HLU}$ and $\overline{HLD}$, hereinbefore referred to.

Landing and leveling of the elevator car at a floor is accomplished by a hatch transducer system which utilizes inductor plates 56 disposed at each landing, and a transformer 58 disposed on the car 12.

The motor controller 50 includes a speed regulator responsive to the reference pattern provided by the speed pattern generator 48.

Figure 2:
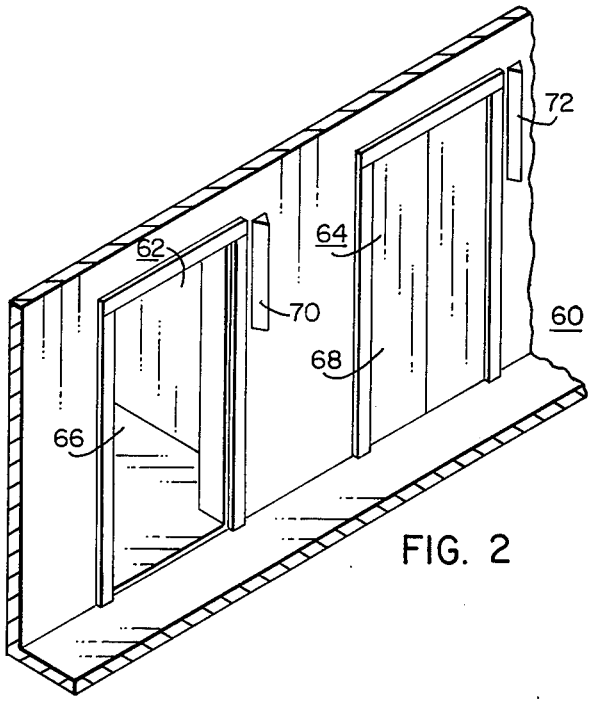
FIG. 2 is a perspective view illustrating hall lanterns which may be constructed according to the teachings of the invention, with the hall lanterns being mounted in the hallway adjacent to the hatch door opening of its associated elevator car.

FIG. 2 is a perspective view of one of the floors 60 of a building illustrating two elevator entrances 62 and 64 for two elevator cars of a bank of elevator cars. An elevator car 66 associated with entrance 62 is shown at the floor 60 with its doors and the hatch doors open, while the hatch doors 68 associated with the entrance 64, are closed. Hall lantern fixtures 70 and 72, which may be of the dynamic type constructed according to the teachings of the invention, are shown mounted in the hallway adjacent to the associated entrances 62 and 64, respectively.

Figure 3:
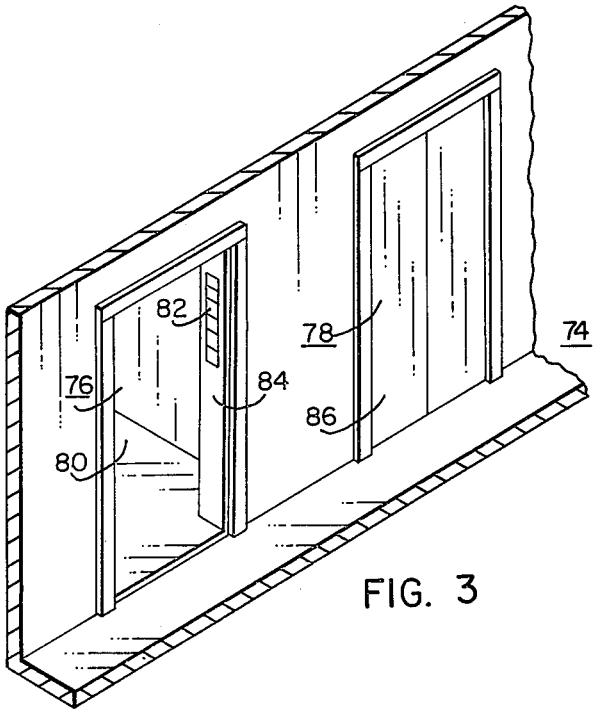
FIG. 3 is a perspective view illustrating hall lanterns which may be constructed according to the teachings of the invention, which lanterns are mounted in the door jamb of the elevator car.

FIG. 3 is a perspective view of one of the floors 74 of a building illustrating two elevator entrances 76 and 78 for two cars of a bank of cars. In this elevator system the hall lanterns are car mounted, instead of being mounted in the hallway as in the FIG. 2 arrangement. An elevator car 80 is shown at floor 74 with its doors and the hatch doors open. Hall lanterns 82, which may be of the dynamic type constructed according to the teachings of the invention, are shown mounted on the door jamb 84 of the car 80, such that they are visible from the hallway when the car and hatch doors are open. The hatch doors 86 associated with entrance 78 are illustrated in the closed position.

FIGS. 4 and 5 are elevational and plan views, respectively, of a new and improved hall lantern fixture 90 constructedaccording to an embodiment of the invention. Hall latern fixture 90 includes an array of electrically energizable elements which are arranged in predetermined rows and columns. In the illustrated embodiment, 18 elements, references E1 through E18 are shown, but as will be hereinafter explained, the specific number of elements is not critical.

The elements E1 through E18 are arranged in 7 rows and 5 columns, with alternate rows having three elements and with the intervening rows having two elements. Alternate columns have four elements, and the intervening columns have three elements. Thus, the first or uppermost row includes elements E1, E2 and E3, the second row includes elements E4 and E5, etc. The first column includes elements E1, E6, E11 and E16, the second column includes elements E4, E9 and E14, etc.

FIGS. 6 and 7 are elevational and plan views, respectively, of a hall lantern fixture 90′ which is similar to the fixture 90 shown in FIGS. 4 and 5, except it has only 10 elements. The row and column placement of the elements is the same as the intermediate three columns of the fixture shown in FIGS. 4 and 5, and the same element references have been used in FIG. 6 to indicate the similarity.

FIGS. 8 and 9 are elevational and plan views, respectively, of a hall lantern fixture 90″ which utilizes two of the fixtures 90′ shown in FIG. 6 arranged in side-by-side relation in a V-shape such that their adjoining portions are spaced outwardly from the wall 92. This V-shaped cross sectional configuration enables the elements of the hall lantern fixture 90″ to be clearly visible from any angle. It would also be suitable to utilize a single vertical column of elements behind a prism which enables the elements to be viewed from any angle.

FIGS. 10A through 10F illustrate the dynamic aspect of the fixture or display 90, with FIGS. 10A through 10C illustrating a sequence of different patterns which visually indicate the up service direction of the associated elevator car as selected by the floor selector 34 and signified by signal $\overline{HLU}$ going to the logic zero level. When signal $\overline{HLU}$ goes to a logic zero, pattern selection means associated with the fixture 90 simultaneously energizes elements E12, E14, E15, E16 and E18, forming the inverted V configuration or chevron shown in FIG. 10A. At the end of a predetermined period of time, the elements shown in FIG. 10A are deenergized and elements E7, E9, E10, E11 and E13 are energized, as shown in FIG. 10B. The elements in FIG. 10B may be energized simultaneously with the deenergization of the elements shown in FIG. 10A, or a short delay may separate the deenergization of the elements of FIG. 10A and the energization of the elements of FIG. 10B, as desired. As shown in FIG. 10B, the configuration of the energized elements is the same as the FIG. 10A configuration, i.e., an inverted V, but the pattern has moved upwardly from its FIG. 10A position.

In like manner, when the elements of FIG. 10B are deenergized at the end of a predetermined period of time, elements E2, E4, E5, E6 and E8 are energized, either immediately, or with a time delay, as hereinbefore described. This pattern of energized elements, shown in FIG. 10C, has the same configuration as the FIG. 10A and FIG. 10B patterns, but it has moved upwardly from the FIG. 10B position. The sequence then repeats through the FIG. 10A, FIG. 10B and FIG. 10C patterns, until signal $\overline{HLU}$ returns to a logic one.

The first time the hall lantern fixture 90 is sequenced through the patterns shown in FIGS. 10A through 10C, it is desirable to provide an audio signal which will call attention to the fact that the hall lantern fixture has been energized. It is also preferable that instead of a single "gong", that the audio signal either be continuous throughout the initial steps of the sequence, or that a new audio signal be provided at the start of each new pattern of the sequence. As disclosed in U.S. Pat. No. 2,980,886, which is assigned to the same assignee as the present application, it would also be desirable to audibly indicate the selected service direction which the car will take away from the floor. The pitch or frequency of the signal may be varied, the signal magnitude may be varied, or both may be varied, to indicate travel direction. If a plurality of discrete audio signals or tones are used, the frequency and/or amplitude of each succeeding tone may increase in indicate the up service direction, and decrease to indicate the donw service direction. If a single audio signal is used which persists throughout the pattern changes of the first sequential pattern, it may have a continuous variation in frequency, and/or amplitude.

FIGS. 10D through 10F illustrate the use of the hall lantern fixture 90 shown in FIG. 4 to visually indicate the down service direction. The first pattern of the down service sequence, shown in FIG. 10D, energizes elements E1, E3, E4, E5 and E7, to provide a V-shaped pattern at the upper portion of the fixture. FIG. 10E illustrates the same V-shape, but it has moved to the center of the fixture, by energizing elements E6, E8, E9, E10 and E12. FIG. 10F illustrates the V-shape at the bottom portion of the fixture by energizing elements E11, E13, E14, E15 and E17.

FIGS. 10A through 10F also apply to the fixtures 90′ and 90″ shown in FIGS. 6, 7, 8 and 9, by eliminating the energized elements in the first and last columns.

FIGS. 11A through 11F illustrate alternate patterns which may be used for the hall lantern fixture 90 shown in FIG. 4. In this embodiment, in addition to a "moving" V, or inverted V, a tail is added to the pattern of FIGS. 10A–10F which grows in length with each new step of the sequential pattern. For example, in the up service sequence, FIG. 11A is similar to FIG. 10A, except element E17 is also energized. The next step of the sequence, shown in FIG. 11B, is similar to the FIG. 10B pattern, except elements E12 and E17 are also energized. The final step, shown in FIG. 11C is similar FIG. 10C, except elements E7, E12 and E17 are also energized.

In the down service sequence, the patterns shown in FIGS. 11D, 11E and 11F are similar to the patterns shown in FIGS. 10D, 10E and 10F, respectively, except for the addition of element E2 in FIG. 11D, elements E2 and E7 in FIG. 11E, and elements E2, E7 and E12 in FIG. 11F.

FIG. 12 is an elevational view of a hall lantern fixture 100 having four rows and seven columns of electrically energizable elements, with each row having seven elements and each column having four elements. In this embodiment, a triangular configuration is formed which appears to grow in size in the direction of elevator service. FIGS. 13A through 13C illustrate the up service sequence, with the triangular pattern which is formed pointing in the upward direction. The base of the triangular pattern remains in the bottom row of the elements, while the triangular pattern enlarges towards the top of the fixture. FIGS. 13D through 13F illustrate the down service sequence.

FIGS. 14 and 15 illustrate elevational and plan views, respectively, of still another hall lantern fixture of the dynamic type, constructed according to the teachings of the invention. In this embodiment, a single vertical column of electrically energizable elements are used, with six elements L1 through L6 being illustrated, but any number of elements starting with three may be used. At least three elements are preferred, because two elements might lead to confusion, unless definite delay is introduced between the finish of one sequence and the start of the next sequence.

FIGS. 16 and 17 are elevational and plan views, respectively, of a hall lantern fixture 112 constructed by using two of the fixtures 110 shown in FIG. 14, with the adjoining edges angled outwardly from the wall to provide excellent viewing regardless of the location of the prospective passenger relative to the fixture. It would also be suitable to utilize the single vertical column of elements shown in FIG. 14, with a prism arrangement which enables the fixture to be viewed from any angle.

FIGS. 18A through 18H illustrate an up service sequence, and FIGS. 19A through 19H illustrate a down service sequence, which sequences may be used for the hall lantern fixtures 110 and 112. The first and last steps of the sequence, illustrated at FIGS. 18A and 18H, respectively, for up service, and at FIGS. 19A and 19H, respectively, for down service, may simply turn all of the elements off to provide a delay between the repeating sequences. The patterns between FIGS. 18A and 18H are energized starting at the bottom of the column, by energizing a single element at the bottom, and then deenergizing this element, and then energizing the next higher element in the column, etc. to provide a spot of light which moves upwardly through the array of elements. In like manner, the patterns between FIGS. 19A and 19H provide a spot of light which moves downwardly through the array of elements.

FIGS. 20A through 20H illustrate still another sequencing pattern which may be used for the hall lantern fixtures 110 and 112. In this embodiment, instead of deenergizing each element after it has been energized, the elements remain energized, once energized, for the duration of the sequence, providing a column of energized elements which appears to grow in length in the same direction as the selected elevator car service direction. FIGS. 20A through 20H illustrate the sequence for down service, starting at the top of the fixture and adding a new element during each additional step of the sequence.

The initial sequencing of the hall lantern fixture 110, or 112 is preferably accompanied by an audio signal, or signals, which audibly indicate the selected service direction, as hereinbefore explained.

The fixture elements are preferably solid state devices because of their compatibility with low level solid state circuitry commonly used in elevator control, low power consumption, and long service life. The light emitting diode (LED) is especially useful in the hall lantern fixtures hereinbefore described, but the LED array or grid may be replaced by incandescent or neon lights, an electroluminescent array, a gas discharge panel, transmissive or reflective liquid crystals, PLZT ceramics, electrophoretics, electrochromics, or any other display technology for which there is a change in contrast in the display when the electrical energization of a point in the array is changed.

Figure 21:
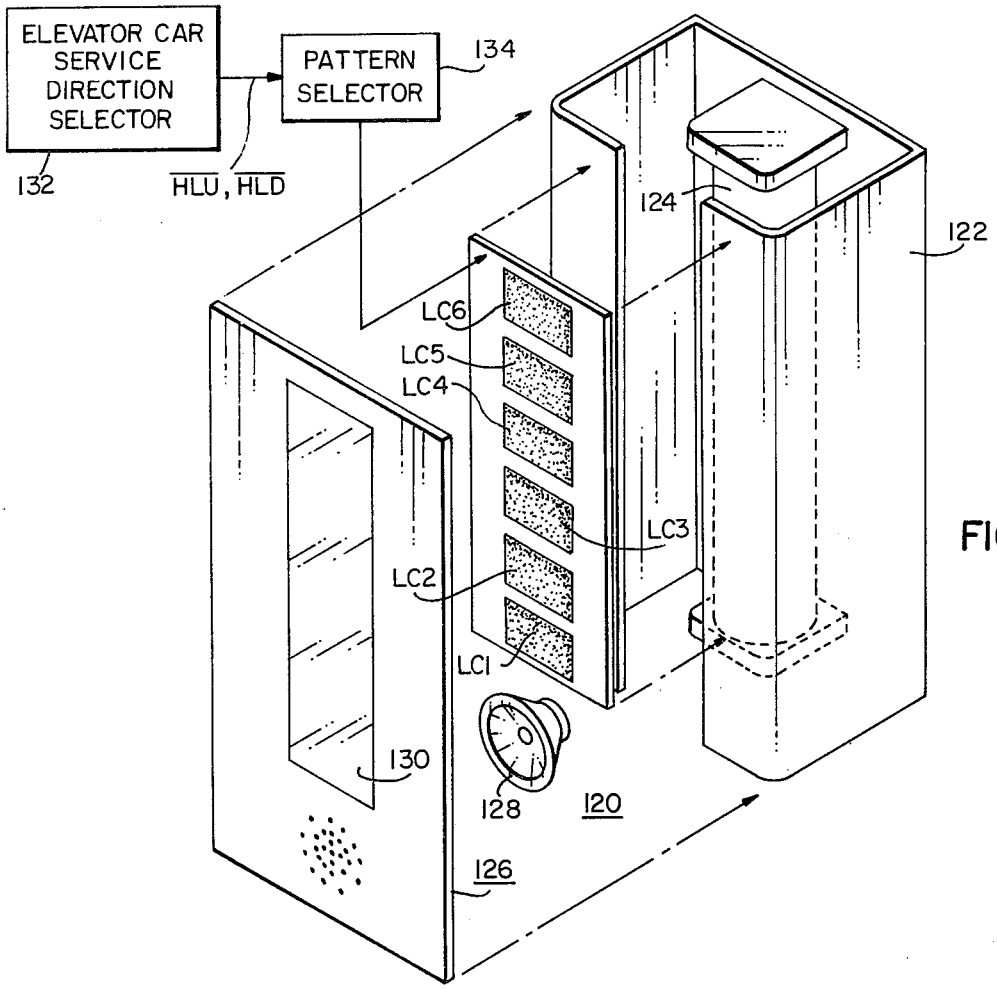
FIG. 21 is an exploded, perspective view of a hall lantern fixture constructed according to an embodiment of the invention which uses light valves.

Liquid crystals used in the transmissive mode, for example, may be used to construct a hall lantern fixture similar to the hall lantern fixture 110 shown in FIG. 14, using a continuously energized lamp, such as a fluorescent lamp. FIG. 21 is an exploded, perspective view of a hall lantern fixture 120 which has the long life operating advantage of the signal entry station, such as an elevator car call entry and display station, disclosed in co-pending application Ser. No. 578,302, filed May 16, 1975, which is assigned to the same assignee as the present application.

More specifically, hall lantern fixture 120 includes a housing 122, a light source 124 adapted for continuous energization, at least when the elevator car is operative to receive car and hall calls, a plurality of electro-optic light valves LC1 through LC6, a cover 126, and a speaker 128 for providing audio tones during the first or initial sequencing of the hall lantern fixture 120.

The light source 124 is an electric lamp, preferably a mercury vapor lamp such as a fluorescent lamp, but any source of visible light may be used, conventional or solid state. Two continuously energized fluorescent lamps may be used, it desired, with the second lamp being used as a backup. The electro-optic light valve is a passive device, i.e., it is not a light source. It is a light shutter or valve, operable between light blocking and light transmitting conditions by application and removal of an electrical signal. While any suitable electro-optic light valve may be used, such as a dynamic scattering liquid crystal, or a field effect liquid crystal, the latter is preferred in an elevator application because of its miniscule use of electrical power.

The plurality of liquid crystals LC1 through LC6 are disposed in a vertical column between the light source 124 and the cover 126. Cover 126 includes a portion 130 aligned with the liquid crystals, which portion is formed of light transmissive material, i.e., transparent or translucent, with a polycarbonate such as Lexan or Rexolite, being suitable.

In the operation of the fixture 120, the field effect liquid crystals would normally be deenergized and the light provided by the continuously energized light source 124 would be barely visible on the outer side of the cover 126. When the hall lantern fixture 120 is energized by a true signal $\overline{HLU}$ or $\overline{HLD}$ from the elevator car service direction selector circuitry, shown generally at 132, which operates the hall lantern pattern selector, shown generally at 134, the liquid crystals LC1 through LC6 may be selectively energized in a manner similar to FIS. 18A-18H and FIGS. 19A–19H for the up and down service directions, respectively, or alternatively they may be energized as shown in the FIGS. 20A–20H embodiment.

Figure 22:
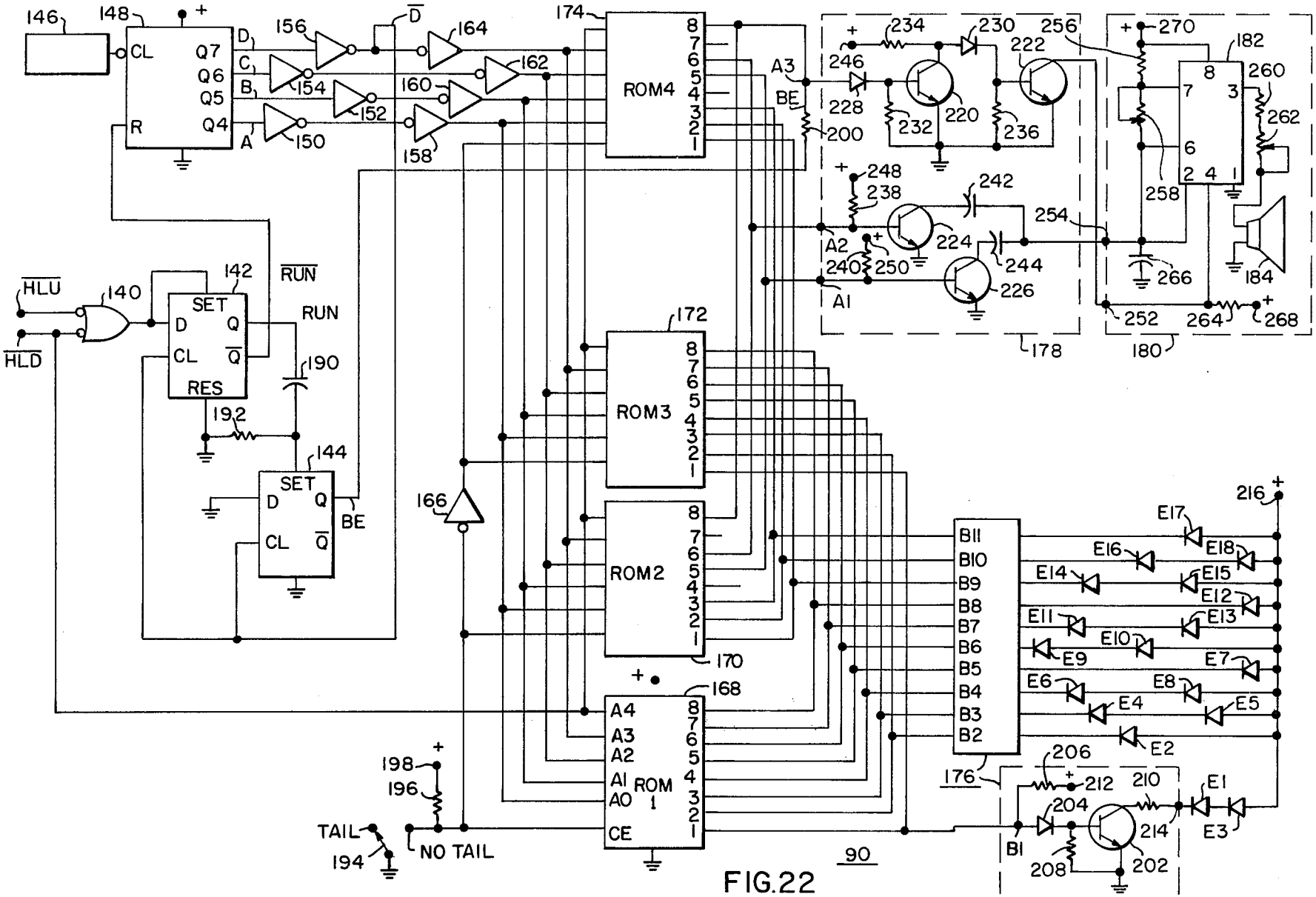
FIG. 22 is a schematic diagram of the hall lantern fixture shown in FIG. 4 and pattern selection control circuitry for selectively energizing the elements of the array.

FIG. 22 is a schematic diagram of the hall lantern fixture 90 shown in FIG. 4, including pattern selection circuitry which may be used for providing the desired patterns, and sequences of patterns, which implement the dynamic aspect of the hall lanterns.

More specifically, hall lantern fixture 90 includes a NAND gate 140, D-type flip-flops 142 and 144, a clock 146, a binary counter 148, inverter or NOT gates 150, 152, 154, 156, 158, 160, 162, 164 and 166, first, second and third programmable read-only memories 168, 170, 172 and 174, buffers 176, electrically energizable elements E1 through E17 which are arranged in the hall lantern fixture as illustrated in FIG. 4, means 178 for providing a plurality of different audio frequencies or tones for the audio portion of the hall lantern fixture, and means 180, including a timer 182 and a speaker 184, responsive to the audio frequencies for providing the audio signals for the prospective passengers.

Commercially available devices which may be used for the various items of the hall lantern fixture 90 shown in FIG. 22 are as follows:

| | |
|---|---|
| NAND 140 | RCA's CD 4011 |
| D-Flip-Flops 142 and 144 | RCA's CD 4013 |
| Counter 148 | RCA's CD 4024 |
| Inverters 150, 152, 154, 156 | RCA's CD 4049 |
| Inverters 158, 160, 162, 164, 166 | Texas Instruments' 7404 |
| ROMS 168, 170, 172, 174 | Intersil's IM 5600 |
| Timer 182 | Signetic'S NE 555 |
| Elements E1 through E17 | Hewlett-Packard's Red LED's 5082-4655 |

The signals $\overline{HLU}$ and $\overline{HLD}$ are applied to the two inputs of NAND gate 140. When the hall lantern fixture 90 should not be active, both signals $\overline{HLU}$ and $\overline{HLD}$ will be at the logic one level and the output of NAND gate 140 will be a logic zero. The output of NAND gate 140 is connected to the D and SET inputs of flip-flop 142, which may be considered to be the "run" flip-flop for the hall lantern fixture 90. The signals appearing at the Q and $\overline{Q}$ outputs of flip-flop 142 are referred to as signals RUN and $\overline{RUN}$, respectively. A logic zero input to SET provides a logic zero at the Q output, and a logic one at the $\overline{Q}$ output. Signal $\overline{RUN}$ is applied to the reset output R of counter 148, and the clock or oscillator 146 is connected to the clock input CL of counter 148.

When signal $\overline{RUN}$ is high counter 148 provides zeros at its Q4, Q5, Q6 and Q7 outputs, referred to as signals A, B, C and D, respectively. When either the up or down hall lantern signal $\overline{HLU}$ or $\overline{HLD}$ goes low, requesting the hall lantern fixture 90 to indicate the up or down service direction, respectively, the output of NAND gate 140 goes high, setting flip-flop 142 to provide a logic one at its Q output and a logic zero at its $\overline{Q}$ output. Thus, signal $\overline{RUN}$ goes low which releases counter 148 to advance one count on the negative going transition of each clock input pulse.

Signal RUN is applied to the SET input of flip-flop 144, which may be considered to be the audio enable flip-flop, and when signal RUN goes high it provides a pulse via capacitor 190 and resistor 192 which sets its Q output to a logic 1, referred to as signal BE. The logic one output enables the audio portion of the hall lantern fixtures, as will be hereinafter described The A, B, C and D output signals, rom counter 148, will provide 16 different binary counts 0000 through 1111, and it will then reset to zeros and repeat the 16 counts, as long as reset input R is low (i.e., signal $\overline{RUN}$ is low). Signal $\overline{D}$ at the output of inverter 156 is connected to the clock inputs of flip-flops 142 and 144. Signal $\overline{D}$ goes to a logic one each time counter 148 resets to zeros, and flip-flops 142 and 144 clock the logic level present at the D input to the Q output on the positive going transition of signal $\overline{D}$. As long as the floor selector 34 shown in FIG. 1 continues to provide a low signal $\overline{HLU}$ or $\overline{HLD}$ the output of NAND gate 140 will continue to be at the logic one level and thus the clock pulse provided by signal $\overline{D}$ has no affect on the Q and $\overline{Q}$ outputs of flip-flop 142, enabling counter 148 to remain active. When signal $\overline{D}$ goes to a logic one at the end of the first count sequence, it transfers the logic zero at the D input of flip-flop 144 to the Q output and signal BE goes low. Thus, signal BE is high for one complete count sequence of counter 148, enabling the audio circuits 178 and 180 for only the initial sequence of patterns, each time one of the signals $\overline{HLU}$ or $\overline{HLD}$ goes to the logic zero level.

Read-only memories 168 and 170 are used when the pattern is to have no tail, i.e., the patterns shown in FIGS. 10A through 10F, and read-only memories 172 and 174 are used when the pattern is to have a tail, i.e., the patterns shown in FIGS. 11A through 11F. If the hall lantern fixture 90 is not to have the flexibility of choosing between the patterns, only two read-only memories would be required. The desired pattern is selected by a switch 194, a resistor 196, and a source of positive unidirectional potential, represented by terminal 198. When a tail is to by provided on the pattern, the CE inputs of read-only memories 168 and 178 are high, which disables these devices, and the logic one level is inverted by inverter 166 to provide a logic zero at the CE inputs of read-only memories 172 and 174, which enables these devices. When switch 194 selects the "No tail" pattern it grounds the CE inputs of memories 168 and 170 to thus enable these devices, and inverter 166 applies a logic one to the CE inputs of memories 172 and 174, disabling these devices.

The A4 inputs of memories 168, 170, 172 and 174 are each connected to input signal $\overline{HLD}$. When $\overline{HLD}$ is at the logic zero level the first 16 8-bit words of the memories will be enabled, and when $\overline{HLD}$ is at the logic one level, the second 16 eight-bit words of the memories will be enabled.

Outputs 1 through 8 of memory 168 and outputs 1 through 3 of memory 170 are connected to inputs B1 through B11, respectively, of the LED buffer circuits 176. In like manner, outputs 1 through 8 of memory 172 and outputs 1 through 3 of memory 174 are connected to inputs B1 through B11, respectively of buffer circuits 176. Outputs 5, 6 and 8 of memories 170 and 174 are connected to inputs A1, A2 and A3, respectively, of the audio frequency selection circuit 178. Signal BE from flip-flop 144 is connected to the A3 input via a resistor 200.

Each of the LED buffer circuits 176 are of like construction, so only the buffer circuit associated with input B1 is shown in detail. Buffer circuit 176 for input B1 includes an NPN transistor 202, a diode 204, resistors 206, 208 and 210, a source 212 of positive unidirectional potential, and an output terminal 214. Input terminal B1 is connected to the base of transistor 202 via diode 204, and it is also connected to source potential 212 via resistor 206. The base of transistor 202 is connected to ground via resistor 208, its emitter is connected directly to ground, and its collector is connected to output terminal 214 via resistor 210. Output terminal 214 is connected to source potential 216 via serially connected LED's E1 and E3. Thus, when output terminal B1 goes high, transistor 202 turns on to energize LED's E1 and E3. When input terminal B1 is low, transistor 202 is off and LED's E1 and E3 are deenergized.

The enabled memories are programmed to energize predetermined LED's or elements on the 16 input addresses provided to the memories by signals A, B, C and D from the counter 148. The programming of memories 168 and 170 for the "No tail" pattern is shown in FIG. 23, and the programming of memories 172 and 174 for the "tail" pattern is shown in FIG. 24.

FIG. 23 illustrates the 16 programmed output words for the memories 168 and 170 in response to the 16 input addresses when signal $\overline{HLD}$ is zero, and the 16 programmed output words for memories 168 and 170 in response to the 16 input addresses when signal $\overline{HLD}$ is a logic one.

When the input address is 0000, or 0 in Hex code, the output of memories 168 and 170 are all zeros, none of the elements are energized, and the audio tone is not enabled. On the first count, Hex code one, outputs 1, 3 and 5 of memory 168 go to the logic one level and output 8 of memory 170 goes to the logic one level. Outputs 1, 3 and 5 of memory 168 energize elements E1, E3, E4, E5 and E7, providing the first pattern of the down service sequence shown in FIG. 10D, and output 8 of memory 170 enables the audio circuits 178 and selects the high tone. These outputs are maintained during the Hex output counts 1 through 4. If a delay between the termination of the pattern shown in FIG. 10D and the pattern shown in FIG. 10E is desired, Hex count 5 may cause memories 168 and 170 to output all zeros, in order to deenergize all of the elements. Hex count 6 causes outputs 4, 6 and 8 of memory 168 to go to a logic one, and outputs 6 and 8 of memory 170 to go to a logic one. Outputs 4, 6 and 8 of memory 168 energize elements E6, E8, E9, E10 and E12, providing the pattern shown in FIG. 10E, and outputs 6 and 8 of memory 170 select the medium audio tone. These outputs persist until Hex code A, which turns the display off, and Hex code B causes output 7 of memory 168 to go to the logic one, and outputs 1, 3, 5 and 8 of memory 170 to go to a logic one. Output 7 of memory 168 and outputs 1 and 3 of memory 170 energize elements E11, E13, E14, E15 and E17, which is the pattern shown in FIG. 10F. Outpus 5 and 8 of memory 170 select the low audio tone. With this description of the coding for the down sequence for the "No tail" embodiment, the up sequence when $\overline{HLD}$ is a logic one may easily be determined. The programming of memories 172 and 174, shown in FIG. 24, also needs no description, as it is explained in the same manner as the program of FIG. 23.

The audio circuitry 178 selects the high, medium and low audio tones. Signal BE is the first of two enables, and when it goes high along with a high output 8 from memory 170 or from memory 174, terminal A3 goes high to enable the audio circuitry 178.

The audio circuit 178 selects the high, medium or low audio tones, and it includes NPN transistors 220, 222, 224 and 226, diodes 228 and 230, resistors 232, 234, 236, 238 and 240, capacitors 242 and 244, and a source of unidirectional potential represented by terminals 246, 248 and 250.

Diode 228 is connected between input terminal A3 and the base of transistor 220. The base of transistor 220 is also connected to ground via resistor 232, and its emitter is connected directly to ground. The collector of transistor 220 is connected to source 246 via resistor 234, and also to the base of transistor 222 via diode 230. The base of transistor 222 is also connected to ground via resistor 236, the emitter of transistor 222 is connected to ground, and its collector is connected to input terminal 252 of the audio circuit 180. The base of transistor 224 is connected to input terminal A2 and to source 248 via resistor 238. Its emitter is connected to ground and its collector is connected to input terminal 254 of audio circuit 180 via capacitor 242. The base of transistor 226 is connected to input terminal A1 and to source 250 via resistor 240. Its emitter is connected to ground and its collector is connected to input terminal 254 of audio circuit 180 via capacitor 244.

Audio circuit 180 includes timer 182, speaker 184, resistors 256, 258, 260, 262 and 264, capacitor 266, and a source of positive unidirectional potential represented by terminals 268 and 270. Terminal 1 of timer 182 is connected to ground, terminal 4 is connected to input terminal 252 and to source 268 via resistor 264, terminal 2 is connected to input terminal 254, to ground via capacitor 266, and to terminal 6. Timer terminal 6 is connected to source 270 via resistors 258 and 256, the junction of resistors 258 and 256 is connected to timer terminal 7, timer terminal 8 is connected to source 270, and timer terminal 3 is connected to one input of speaker 184 via resistors 260 and 262. The other input of speaker 184 is grounded.

In the operation of the audio circuits 178 and 180, when signal BE is high and output 8 of either memory 170 or memory 174 is high, transistor 220 turns on and transistor 222 turns of, applying a logic one to terminal 4 of timer 182, which starts the timer and provides an output tone having a frequency selected by the ratio of resistors 256 and 258 and the value of the capacitance connected to the timer terminal 2. Resistor 258 may be adjustable in order to select the desired ratio of the resistors, and thus the tone level for each value of capacitance connected to the timer terminals 2 and 6. When output 8 of memory 170 or memory 174 is at the logic one level and outputs 5 and 6 of the same memories are at the logic zero level, the only capacitor connected to timer terminals 2 and 6 will be capacitor 266, providing the highest output frequency, and thus the highest pitched tone for the speaker 184. When the intermediate or medium tone is desired, outputs 6 and 8 of memory 170 or memory 174 will both be at the logic one level, adding capacitor 242 in parallel with capacitor 266, which increases the capacitance and reduces the frequency of the audio signal. When the lowest audio tone is desired, outputs 5 and 8 of memory 170, or memory 174, will both be at the logic one level, adding capacitor 244 in parallel with capacitor 266. Capacitor 244 has a higher value of capacitance than capacitor 242, in order to reduce the tone level below that provided by the parallel connected capacitors 242 and 266.

Resistor 262 may be adjustable to provide the required volume level for the audio signal.

When the low or true signal $\overline{HLU}$ or $\overline{HLD}$ applied to NAND gate 140 goes high, the output of NAND gate 140 will go low and the next time counter 148 goes to zero at the end of a sequence, signal $\overline{D}$ will clock flip-flop 142 and stop the counter 148.

Figure 25:
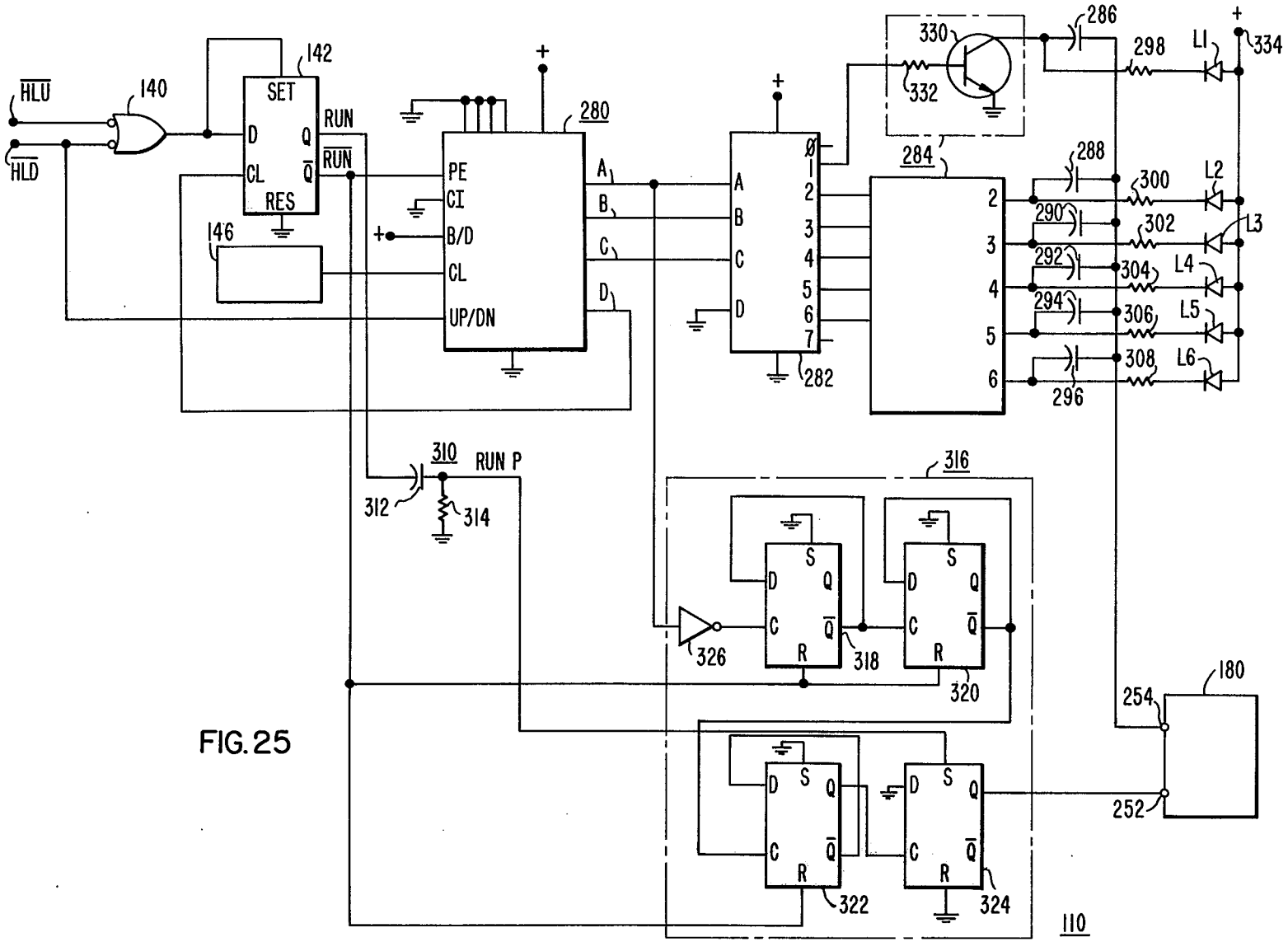
FIG. 25 is a schematic diagram of the hall lantern fixture shown in FIG. 14, with pattern selection control circuitry for developing the patterns and sequences shown in FIGS. 18A–18H, and FIGS. 19A–19H.

FIG. 25 is a schematic diagram of a hall lantern fixture and pattern selection circuit which may be used for the hall lantern 110 shown in FIG. 14. The pattern selection circuitry of FIG. 25 selects the patterns and sequences thereof shown in FIGS. 18A–18H, and FIGS. 19A–19H. FIG. 25 is a schematic diagram of a hall lantern fixture and pattern selection circuitry which also may be used for the hall lantern fixture 110 shown in FIG. 14, but the pattern selection circuitry in FIG. 25 provides the type of patterns and sequences thereof shown in FIGS. 20A–20H. Functions in FIGS. 22, 25 and 26 which are similar are given the same reference numerals and will not be described again in detail.

More specifically, hall lantern fixture 110 shown in FIG. 25 includes NAND gate 140, run flip-flop 142, clock 146, and up/down counter 280, a one-of-eight decoder 282, buffer circuits 284, capacitors 286, 288, 290, 292, 294, and 296, resistors 298, 300, 302, 304, 306 and 308, LED's L1 through L6, a pulse circuit 310 which includes a capacitor 312 and resistor 314, a counter circuit 316 which includes D-type flip-flops 318, 320, 322 and 324, and inverter 326, and a timer and speaker circuit 180. The up/down counter may be RCA's CD 4029, and the decoder 282 may be RCA's CD 4028.

When either signal $\overline{HLU}$ or $\overline{HLD}$ goes low, NAND gate 140 will provide a logic one to the D and SET inputs of flip-flop 142, providing a high RUN signal and a low $\overline{RUN}$ signal at the Q and $\overline{Q}$ outputs, respectively. The counter 280, which had pre-set its A, B, C and D outputs to zero when the present enable input PE was high, now has a low preset enable input which allows the counter to be advanced one count on the positive going transition of the clock 146. The counter 280 counts up when signal $\overline{HLD}$ is high, and down when signal $\overline{HLD}$ is low, as signal $\overline{HLD}$ is connected to the UP/DN input of the counter. The A, B and C outputs of counter 280 are connected to the decoder 282, and its D output is connected to the clock input CL of flip-flop 142. When D goes to a one, the run flip-flop 142 will be reset when the output of NAND gate 140 is again at the logic zero level. When $\overline{HLD}$ is high, the counter 280 will count up and the decoder 282 will successively drive its outputs 1 through 6 to the logic one level. When signal $\overline{HLD}$ is low, counter 280 will count down and decoder 282 will successively drive its outpus 6 through 1 to a logic one. However, only one of the outputs at any one time is at the logic one level.

Buffers 284 for each decoder output are all similar, and thus only the buffer for output 1 is shown in detail. Buffer 284 includes an NPN transistor 310, and a resistor 332. Output 1 of decoder 282 is connected to the base of transistor 330 via resistor 332, its emitter is connected to ground, and its collector is connected to a source 334 of positive unidirectional potential via resistor 298 and element L1. The collector is also connected to input terminal 254 of the timer and speaker circuit 180. Output 2 of buffer 284 is connected to source 334 via resistor 300 and element L2, and also to terminal 254 via capacitor 288. Output 3 of buffer 284 is connected to source 334 via resistor 302 and element L3, and also to terminal 254 via capacitor 290. Output 4 of buffer 284 is connected to source 334 via resistor 304 and element L4, and also to terminal 254 via capacitor 292. Output 5 is connected to source 334 via resistor 306 and element L5, and also to terminal 254 via capacitor 294. Output 6 is connected to source 334 via resistor 308 and element L6, and also to terminal 254 via capacitor 296.

The signal RUN from flip-flop 142 is applied to the pulse circuit 310, providing a pulse RUNP when signal RUN goes to a logic one.

Flip-flops 318, 320, 322 and 324 are connected in a counting arrangement such that the Q output of flip-flop 324, which is connected to input terminal 252 of the timer and speaker circuit 180 goes to a logic zero at the end of one complete count cycle of the counter 280. The signal RUNP is connected to the SET input of flip-flop 324 to set the Q output to a logic one, which output is connected to the input terminal 252 of the timer and speaker circuit 180. Thus, the timer and speaker circuit is enabled when signal RUN goes high at the start of a hall lantern operation, and it is disabled after one complete counting cycle, such that the audio tones are produced only during the first run through the hall lantern patterns. Signal $\overline{RUN}$ resets the counter 316 when the hall lantern operation has been completed. Capacitors 286, 288, 290, 292, 294 and 296 are selected to be progressively smaller in value, in order to increase the pitch of the tones when the elements are energized from L1 through L6 and to decrease the pitch of the tones when the elements are energized from L6 through L1.

Figure 26:
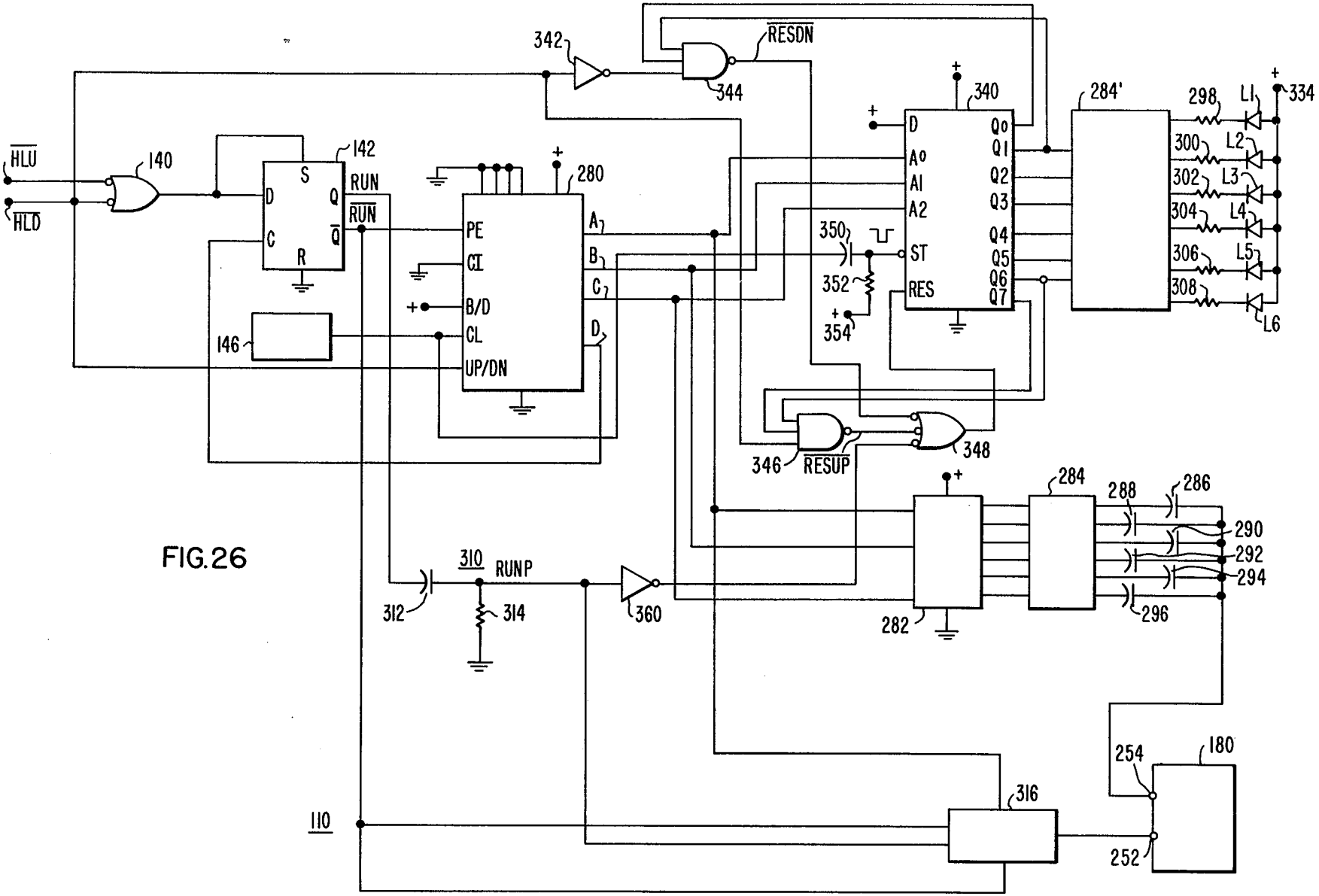
FIG. 26 is a schematic diagram of the hall lantern fixture shown in FIG. 14, with pattern selection control circuitry for developing the patterns and sequences thereof shown in FIGS. 20A–20H.

FIG. 26 is a schematic diagram of a pattern selector circuit for implementing the down service pattern shown in FIGS. 20A–20H, as well as similar patterns for the up service direction, wherein the length of the hall lantern display lengthens in the direction of the elevator service to be provided for a floor. The audio function is similar to that shown in FIG. 25, with the decoder 282 and buffers 284 in this embodiment being used solely for the audio function. The dynamic display function is provided by an addressable latch 340, such as RCA's CD 4099. The LED buffers between the output of the latch 340 and the elements L1–L6 may be similar to the buffers 284, and are thus referenced by 284'.

Resetting of the latch 340 is accomplished by providing a down reset signal $\overline{RESDN}$, by providing an up reset signal $\overline{RESUP}$, and by connecting these reset signals along with the pulse RUNP, to the inputs of a NAND gate 348. The down reset signal $\overline{RESDN}$ is provided by an inverter 342 and a NAND gate 344. The up reset signal $\overline{RESUP}$ is provided by a NAND gate 346.

The data input D of latch 340 is tied to a logic one. The "store" input ST is connected to the clock 146 via a capacitor, and this input is also connected to a source 354 of positive unidirectional potential via a resistor 352. Thus, each time the clock pulse drives the ST input low, a logic one will appear at the output selected by the address applied to inputs A0, A1 and A2, which addresses are provided by the up/down counter 280. As each output is sequentially driven to a logic one level, the logic one level is retained until the reset input is driven high, at which time the outputs Q0 through Q7 of latch 340 are reset to zeros. Thus, when the up/down counter 280 is counting upwardly, the elements are energized in the order L1 through L6, with each energized element remaining energized for the remaining portion of the count, i.e., until the latch 340 is reset. When counter 280 is counting downwardly, the elements are energized in the order L6 through L1, and each energized element remains energized until the latch 340 is reset.

The down reset signal $\overline{RESDN}$ is provided when outputs Q0 and Q1 of the latch 340 are at the logic one level and the down hall lantern signal $\overline{HLD}$ is low. The up reset signal $\overline{RESUP}$ is provided when the Q6 and Q7 outputs of latch 340 are at the logic one level and the down hall lantern signal $\overline{HLD}$ is high. Any low reset signal $\overline{RESDN}$ or $\overline{RESUP}$, or a high pulse RUNP, which is inverted by an inverter 360 to the logic zero level, will drive the output of NAND gate 348 high to reset the latch 340.

While the dynamic sequential displays of the invention have been specifically described relative to elevator hall lanterns, it is to be understood that they may be applied to any elevator display where the up or down service direction is to be visibly displayed, or visibly displayed accompanied by an audio signal which may also indicate service direction by the frequency of the tone, and/or by the magnitude of the tone.

In summary, there has been disclosed a new and improved elevator system which utilizes a dynamic display which is particularly useful as a hall lantern indicator. A single display functions to visibly indicate the up and the down service directions. The sequential operation of the display enhances visibility and lends itself to the use of long life, low cost solid state devices, such as liquid crystals and LED's. For example, a low cost display may be constructed with LED chips mounted in a molded display cavity. The low voltage drive requirements of the solid state devices reduce the cost of the system interface circuitry and enables low voltage wiring to be used in the wiring ducts. In addition to the enhanced visibility of the displays, improved multi-tone annunciators may be used to provide additional directional information to the handicapped.

We claim as our invention:

1. An elevator system, comprising: a building having a plurality of floors, an elevator car mounted for movement in said building to serve the floors, control means for selecting the service direction in which said elevator car will proceed from a floor it is serving, and display means having an array of electrically energizable elements, said display means including pattern selection means responsive to said control means, said pattern selection means selectively energizing said elements while said elevator car is serving a floor to provide a predetermined sequence of at least three different patterns which visually indicate the selected service direction.

2. The elevator system of claim 1 wherein at least certain of the energizable elements are included in patterns used for both the up and down service directions.

3. The elevator system of claim 1 wherein the elevator car and building include cooperative doors for controlling access to the elevator car, and wherein the display means is carried by the elevator car in a position visible outside the car from a floor at which the car is standing with the doors open.

4. The elevator system of claim 1 wherein the elevator car and building include cooperative doors for controlling access to the car, and wherein the display means is located outside of the elevator car adjacent to the door of the building.

5. The elevator system of claim 1 including audio signal means, said audio signal means providing an audio signal when the pattern selection means energizes the elements to indicate the selected service direction.

6. The elevator system of claim 5 wherein the audio signal includes a plurality of discrete audio signals with a predetermined characteristic of the discrete audio signals changing from signal to signal to indicate the selected service direction.

7. The element system of claim 6 wherein the predetermined characteristic is the frequency of the discrete audio signals, with the frequency increasing from signal to signal when the selected service direction is up, and decreasing from signal to signal when it is down.

8. The elevator system of claim 6 wherein the predetermined characteristic of the discrete audio signals is the sound level, with the sound level increasing from signal to signal when the selected service direction is up, and decreasing from signal to signal when it is down.

9. The elevator system of claim 5 wherein the audio signal is continuous through a sequence of patterns.

10. The elevator system of claim 9 wherein a predetermined characteristic of the audio signal continuously changes to audibly indicate the selected service direction, with the predetermind characteristic increasing when the selected service direction is up, and decreasing when it is down.

11. The elevator system of claim 1 wherein the predetermined sequence of different patterns repeats during the time the car is serving a floor.

12. The elevator system of claim 11 including audio signal means which is energized for only one sequence of the different patterns.

13. The elevator system of claim 1 wherein the one sequence is the first sequence.

14. The elevator system of claim 1 wherein the electrially energizable elements of the array are arranged in a single vertically oriented column.

15. The elevator system of claim 14 wherein the elements are sequentially energized and deenergized to provide an ascending visual signal in response to a selection of the up service direction, and a descending visual signal in response to selection of the down service direction.

16. The elevator system of claim 14 wherein the elements are sequentially energized and each element remains energized for a selected period of time, to provide a visual signal which increases in length in the ascending direction in response to a selection of the up service direction, and which increases in length in the descending direction in response to a selection of the down service direction.

17. The elevator system of claim 1 wherein the electrically energizable elements of the array are arranged in rows and columns, with the different patterns of a predetermined sequence responsive to the selection of the up service direction each including an inverted V-shaped configuration which moves upwardly through the array, and with the different patterns of a predetermined sequence responsive to the selection of the down service direction each including a V-shaped configuration which moves downwardly through the array.

18. The elevator system of claim 17 wherein the inverted V and normal V configurations each include a trailing portion which grows in length with each new pattern of a sequence.

19. The elevator system of claim 1 wherein the electrically energizable elements of the array are arranged in rows and columns, with the different patterns of a predetermined sequence each including a triangular configuration which increases in area with each step of the sequence, with one side of the triangular configuration being horizontal and with the opposite corner thereof being above said side when the selected service direction is up, and below said side when it is down.

* * * * *